US012808298B2

(12) United States Patent
Gleeson

(10) Patent No.: US 12,808,298 B2
(45) Date of Patent: Nov. 24, 2026

(54) MINE ROOF SUPPORT CRIBS

(71) Applicant: Mine Timber Technology (Int) Pty Ltd, Palmview (AU)

(72) Inventor: Adam Gleeson, Palmview (AU)

(73) Assignee: Mine Timber Technology (Int) Pty Ltd, Palmview (AU)

( * ) Notice: Subject to any disclaimer, the term of this patent is extended or adjusted under 35 U.S.C. 154(b) by 48 days.

(21) Appl. No.: 18/975,034

(22) Filed: Dec. 10, 2024

(65) Prior Publication Data

US 2025/0198287 A1 Jun. 19, 2025

(30) Foreign Application Priority Data

Dec. 15, 2023 (AU) ..... 2023904078

(51) Int. Cl.
*E21D 15/48* (2006.01)
*E21D 15/58* (2006.01)

(52) U.S. Cl.
CPC ..... *E21D 15/48* (2013.01); *E21D 15/581* (2013.01)

(58) Field of Classification Search
CPC ..... E21D 15/06; E21D 15/24; E21D 15/52; E21D 15/581; E21D 15/586; E21D 15/48; E04G 25/065
See application file for complete search history.

(56) References Cited

U.S. PATENT DOCUMENTS 1,279,901 A * 9/1918 Phelps ..... E04G 25/065 405/230
1,749,303 A 3/1930 Rutter
1,879,030 A * 9/1932 Bayles ..... E21B 15/006 248/676
2,190,556 A * 2/1940 Wiebecke ..... E21D 15/60 254/133 R
4,307,982 A * 12/1981 Nelson ..... E21D 23/0004 405/297
5,435,670 A 7/1995 Pienaar et al.
5,746,547 A 5/1998 Reinmann et al.
5,868,527 A 2/1999 King et al.
5,980,160 A * 11/1999 Vanderklaauw ..... B66F 1/00 405/230
6,079,910 A 6/2000 Marianski et al.
6,250,849 B1 6/2001 Marianski et al.
(Continued)

FOREIGN PATENT DOCUMENTS

AU 2015101881 A4 2/2017
GB 2353052 A 2/2001
(Continued)

*Primary Examiner* — Benjamin F Fiorello
(74) *Attorney, Agent, or Firm* — Bonini IP Law, LLC; Frank J. Bonini, Jr.

(57) ABSTRACT

A mine crib from interlocking planks has pair of jack planks on opposite slides of the crib comprising an upper plank 19, lower plank 20 equipped with plates 23 and 24 having screw holes 34, 35 and threaded rod pass through holes 36, 37 and 38 so that threaded rods 39, 40 and 41 may slide through the holes and passing to corresponding cavities 42, 43 and 44 in plank 19. Each rod has a nut 45 and washer 46 so that the nut may be used with an appropriate tool so that as the nuts wound upward along the threaded rods then the jack plank sections 19 and 20 may be jacked apart and be used to preload the crib.

4 Claims, 6 Drawing Sheets

(56) References Cited

U.S. PATENT DOCUMENTS

| | | | | |
|---|---|---|---|---|
| 6,352,392 | B1 | 3/2002 | McCartney | |
| 8,851,804 | B2 * | 10/2014 | Hussey | E21D 15/483 248/354.2 |
| 2002/0139077 | A1 | 10/2002 | Heckford | |
| 2003/0068204 | A1 | 4/2003 | Paton-Ash et al. | |
| 2010/0221073 | A1 | 9/2010 | Chugh | |
| 2014/0348596 | A1 * | 11/2014 | Hussey | E21D 15/48 414/801 |
| 2017/0130580 | A1 | 5/2017 | Shook et al. | |
| 2021/0330078 | A1 * | 10/2021 | Plourde | A47B 57/06 |

FOREIGN PATENT DOCUMENTS

| | | | |
|---|---|---|---|
| GB | 2362899 | A | 12/2001 |
| WO | 200056983 | A1 | 9/2000 |
| WO | 2014075143 | A1 | 5/2014 |

* cited by examiner

MINE ROOF SUPPORT CRIBS

TECHNICAL FIELD

THIS INVENTION relates to improved methods and apparatus for preloading a mine roof support crib.

BACKGROUND

Mine cribs usually employ stacked interlocking planks built up from the mine floor to the roof. In some cases wedges are driven between the crib and roof to secure the crib in place.

Mine cribs of this kind have been used for many years. There have not been any new developments in mine cribs of any significance for over 20 years.

Present mine cribs are functional and there is no specific problem with them at the present priority date of the present application that is or was in need of solution. The present invention arises through the inventor's desire to provide a useful alternative to the prior art and in response to the inventor's quite unexpected finding that mining cribs may be satisfactorily preloaded from within the crib or from the mine floor without creating any imbalance or unsafe outcome through the methods described herein.

Examples of mine cribs are described in the following patent specifications, the disclosures of which are incorporated herein by cross reference: U.S. Pat. Nos. 1,749,303; 5,435,670; 5,746,547; 5,868,527; 6,079,910; 6,250,849; WO200056983; GB 2353052; GB 2362899; US 2002/0139077; U.S. Pat. No. 6,352,392; US2003068204; US2010221073; WO2014075143; AU 2015101881; US2017130580.

These specifications demonstrate the wide variety of crib constructions in the prior art, many of which are based on the theme of interlocking planks. Although these documents have been listed these are from a post-invention search and do not constitute an admission of common general knowledge in Australia or anywhere else.

OUTLINE

In one aspect there is provided a mine crib including a preloading assembly located within the crib, the preloading assembly comprising a jack mechanism between crib members adapted to drive the said crib members apart in order to preload the crib. The crib is preferably use stacked elongate members, typically timber planks used in mine between a mine floor and roof and therefore there is also provided, a method of preloading a mining crib, comprising the steps of:—

(a) stacking mining crib planks up to a mine roof in a crib structure having opposed side walls formed by the stacked planks;

(b) preloading the crib by applying forces to spread apart at least two planks in opposite side walls of the crib in a direction toward the mine roof; and (d) securing the crib in the preloaded position.

In a further step, where applied to a crib having a rectangle or square in horizontal profile, the applied force may be by respective jack mechanisms integral with the crib and each jack being between the respective said planks and each jack being operable within the plane of its corresponding side wall. In a further step the effect of jacking planks in opposite sides walls apart causes planks in the adjacent walls to also separate, so there is the further step of inserting a filler in the gaps on the other walls. Thus in this embodiment, each said side wall has respective jack mechanisms integral with the crib and each jack mechanism being between respective members and each jack being operable within the plane of its corresponding side wall for jacking the said members in the opposite sides walls apart, the crib having adjacent walls to the said side walls which also have crib members which are adapted to separate in concert with the crib members of the said opposite side walls forming gaps in the members so separated in the adjacent walls, and there being fillers in the gaps in the adjacent walls.

According to a further aspect of the invention there is provided a crib assembly having stacked generally horizontal crib members extending down from a mine roof to a mine floor, the crib having a preloading assembly located in the crib, and being integral with the crib to apply a load in the vertical direction of the crib. The preloading assembly may comprise a jack mechanism comprising opposed jack plates extending along the line of adjacent crib members and including screw jacks between the plates used to jack the plates apart.

The opposed jack plates comprise upper and lower jack plates sandwiched between plank sections and there being spaced apart threaded rods extending through the plates and each rod having an adjustment nut located between the plates used to jack the plates apart. Thus in a preferred form there is provided a mine crib between a mine floor and a mine roof comprising crib members as an interlocking stack of planks, the jack mechanism being adapted to open the crib axially so that load is applied to the floor and roof, the crib having a square profile and the planks have cut outs so they are located in interlocking fashion, opposed side walls of interlocking planks comprising part way along the side wall a pair of jack planks having recesses matched to and retaining an upper jack plate and lower jack plate, the jack plates being secured in the recesses, seamlessly locate the plates and corresponding jack mechanisms in the side wall of the crib, on each of opposite sides of the crib, each has a step at each end to accommodate short plate sections of the plates, threaded rods and nut arrangement is provided and these are used to jack the plates apart thereby raising the crib. Typically, each side wall has a pair of jack planks comprising an upper plank and a lower plank, opposed plates between the upper and lower planks and having and threaded rods passing through holes in the plates to corresponding plank cavities in the upper plank, each rod having a nut and washer so that the nut may be used with an appropriate tool so that as the nuts are wound upward along the threaded rods then the jack planks may be jacked apart.

BRIEF DESCRIPTION OF THE DRAWINGS

In order that the present improvements may be more readily understood and put into practical effect reference will now be made to the accompanying drawings which illustrate preferred embodiments of the invention and wherein:—

METHOD OF PERFORMANCE

Figure 1:
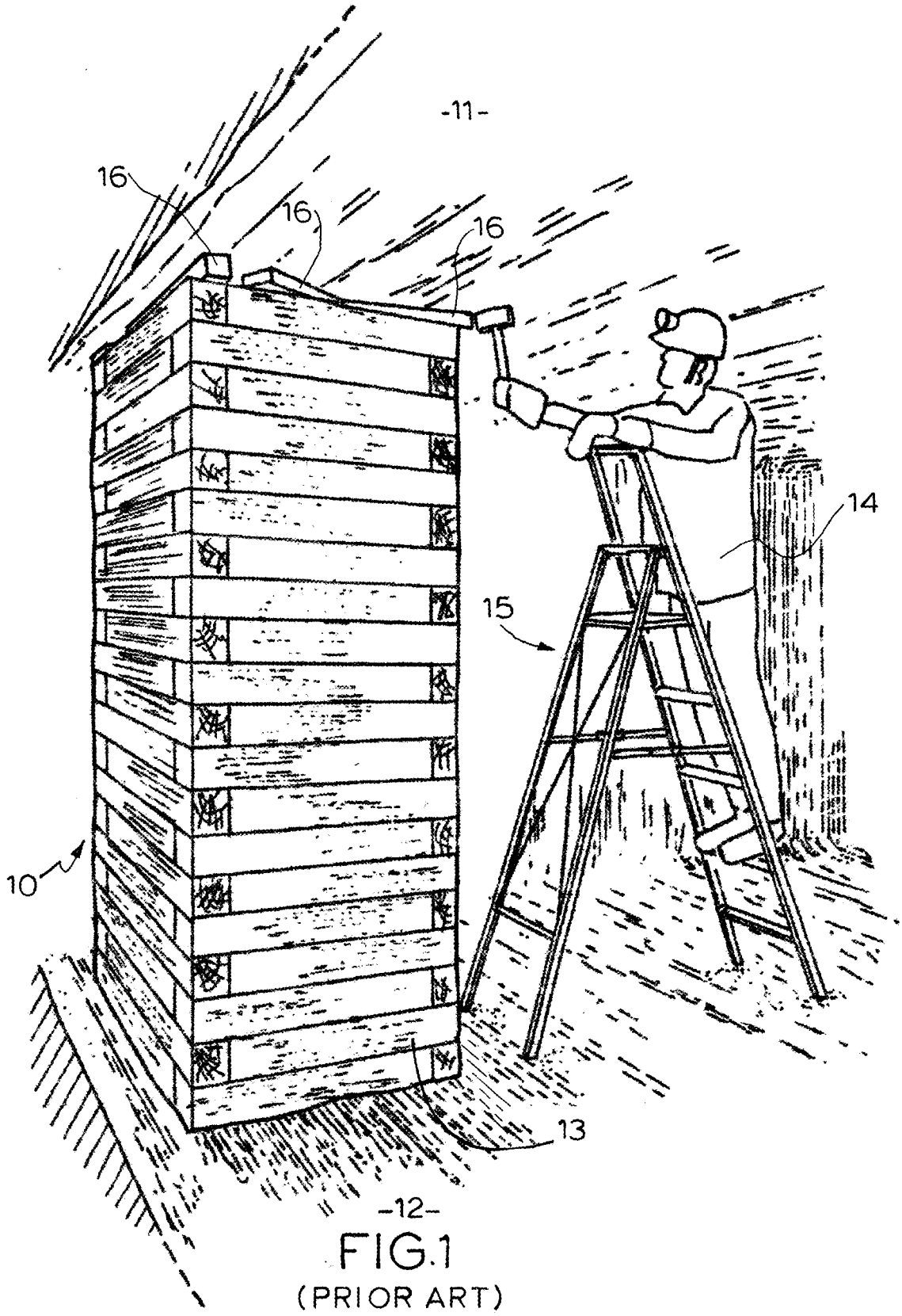
FIG.1 (PRIOR ART)
FIG. 1 is a drawing illustrating one type of crib according to the prior art.

Referring to the drawings and initially to FIG. 1 there is illustrated a mine crib 10 according to the prior art extending between a mine roof 11 and a mine floor 12. The crib 10 is made from an interlocking stack of planks 13 so the crib is hollow up its centre. In order to secure the crib, a mine worker 14 stands on a ladder 15 and drives timber wedges 16 between the top of the crib and the roof 11.

It will be appreciated from FIG. 1 that the mine floor and the mine roof are not perfectly flat surfaces and that the forces along and down through the crib will not be completely uniform. The application of the wedges above the crib and the ability to secure them will depend on the mine worker 14 and his ability and skill to insert and apply the wedges as evenly as possible around the top of the crib. Also it will be appreciated that over time with timber shrinkage the wedges may need repositioning or the crib may become unstable. It will be apparent from the following description that the structure of the crib is not relevant to the present invention but that the preloading method and apparatus described herein may be applied to any crib-like column used in mining.

The present invention envisages as an alternative or an addition to the wedges 16, that the crib be preloaded from within the structure of the crib by opening the crib axially so that load is applied to the floor and roof. In the present invention this can be achieved according to a process that involves separating crib planks axially along the crib or lifting the whole crib to preload the crib, the effect being to push the crib against the roof or both the roof and the floor rather than utilise the process depicted in FIG. 1.

Figure 2:
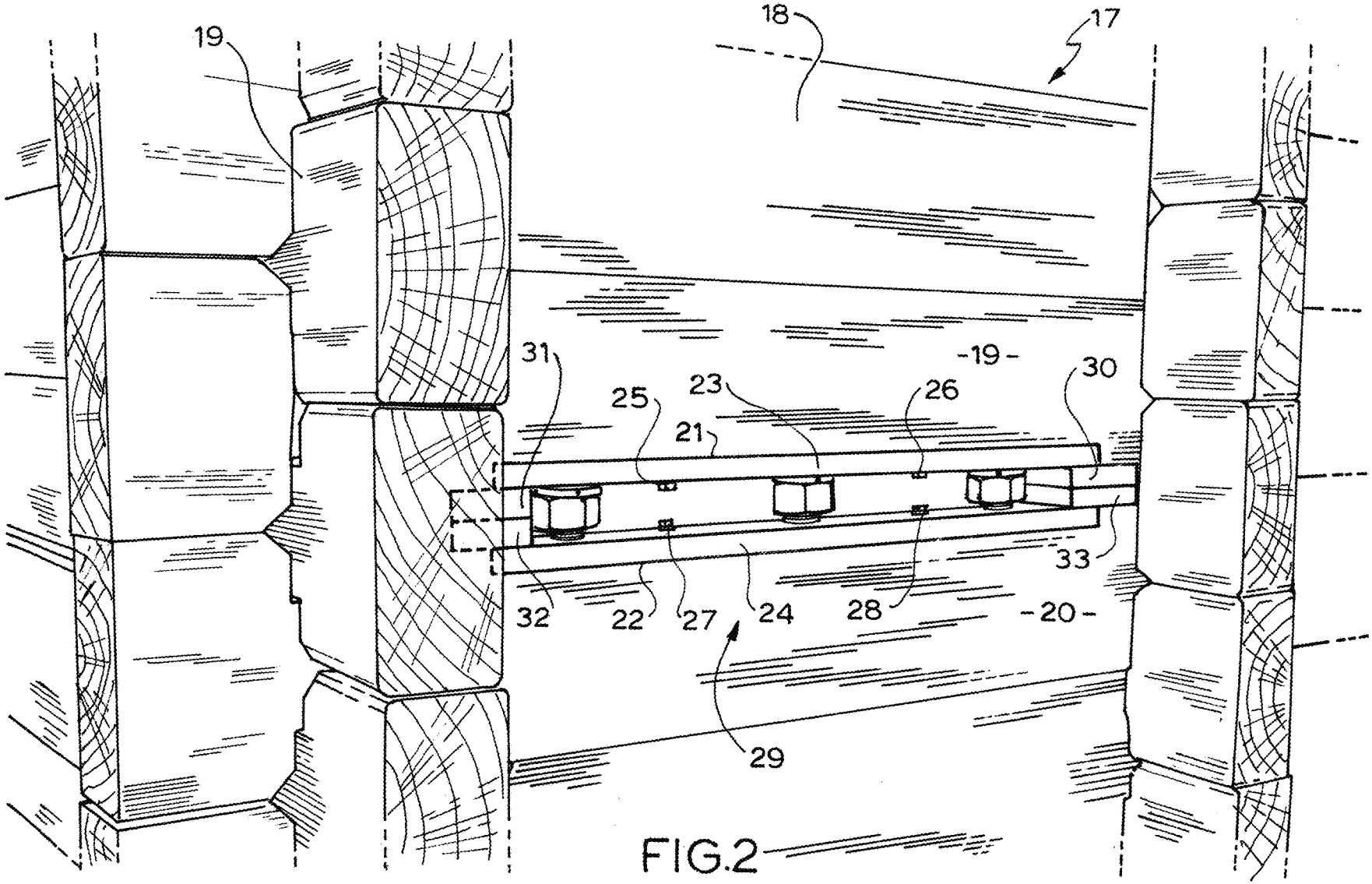
FIG. 2 has a hard side view of a crib incorporating a preferred jack mechanism.

Referring to FIG. 2 there is illustrated a part view of a square crib 17 according to the present invention having planks 18 on one side and planks 19 on the adjacent sides it being appreciated that the side 18 is mirrored on the opposite side of the crib. In this case the crib is a square profile crib and the planks have cut outs so they may be located in interlocking fashion as shown in FIG. 2. Planks 19 and 20 are specially made planks as these have a recess 21 and recess 22 matched to and able to retain an upper jack plate 23 and lower jack plate 24. The jack plates are secured in the recess by screws 25, 26, 27 and 28. As will be described the planks 19 and 20 may be referred to as "jack planks" because these are used to seamlessly locate the plates 23 and 24 and the corresponding jack mechanisms 29 of the side wall of the crib 17. This arrangement is repeated on the opposite side of the crib. As can be seen the recess 21 has a step at each end and this is to accommodate short plate sections 30, 31, 32 and 33 of the plates. The threaded rods, washer and nut arrangement in this case 3 are provided and these are used to jack the plates 23 and 24 apart thereby raising the crib. This is accomplished in this embodiment by raising the planks 19 on opposite to raise the crib.

Figure 3:
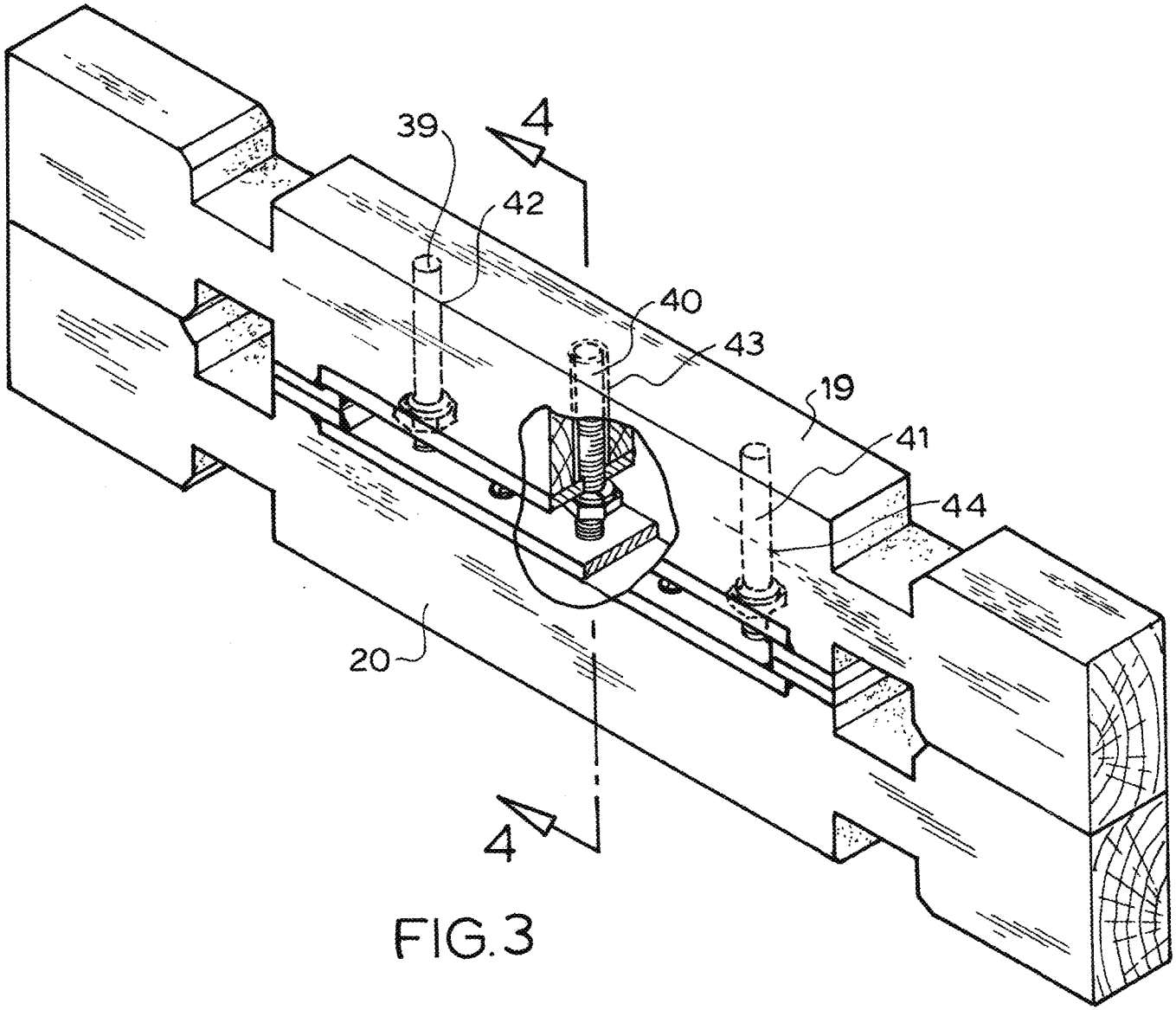
FIG. 3 is a part cutaway view of a plank and jack assembly adapting a jack mechanism to seamlessly be located within the side wall of the crib.
Figure 5:
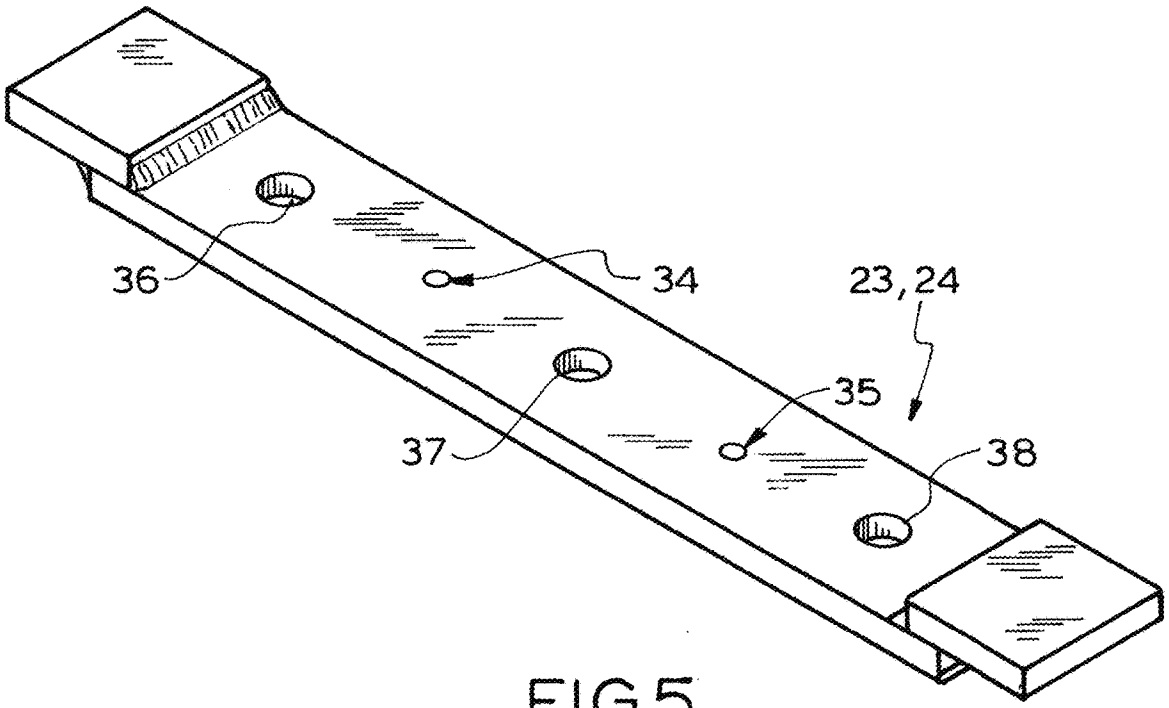
FIG. 5 is a drawing of a jack plate.
Figure 4:
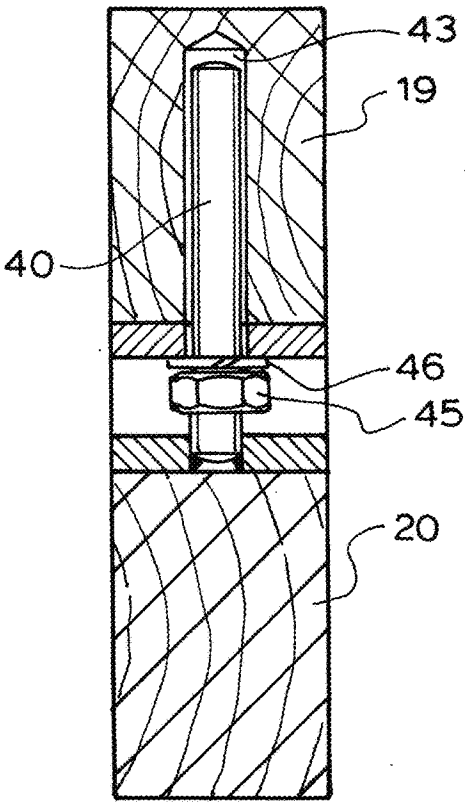
FIG. 4 is a section through 4-4 of FIG. 3.

Referring now to FIGS. 3 to 5 there is illustrated the upper plank 19, lower plank 20 and as can be seen the plates 23 and 24 have screw holes 34, 35 and threaded rod pass through holes 36, 37 and 38 so that threaded rods 39, 40 and 41 may slide through the holes and passing to corresponding cavities 42, 43 and 44 in plank 19. In his case there are no cavities in plank 20. Each rod has a nut 45 and washer 46 so that the nut may be used with an appropriate tool so that as the nuts wound upward along the threaded rods then the jack plank sections 19 and 20 may be jacked apart.

Figure 6:
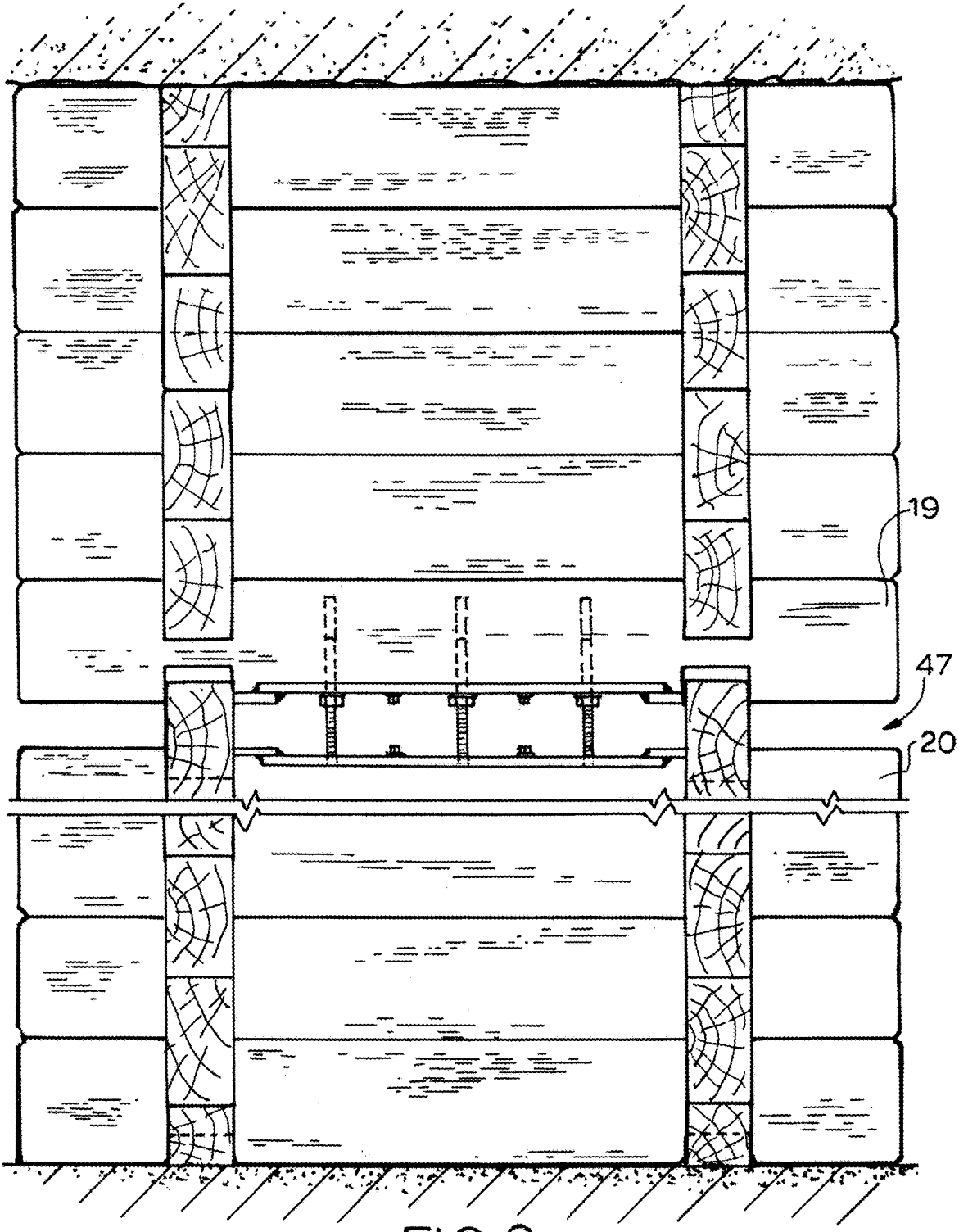
FIG. 6 is a side view of the crib with jack planks and jack mechanism plates shown apart.
Figure 7:
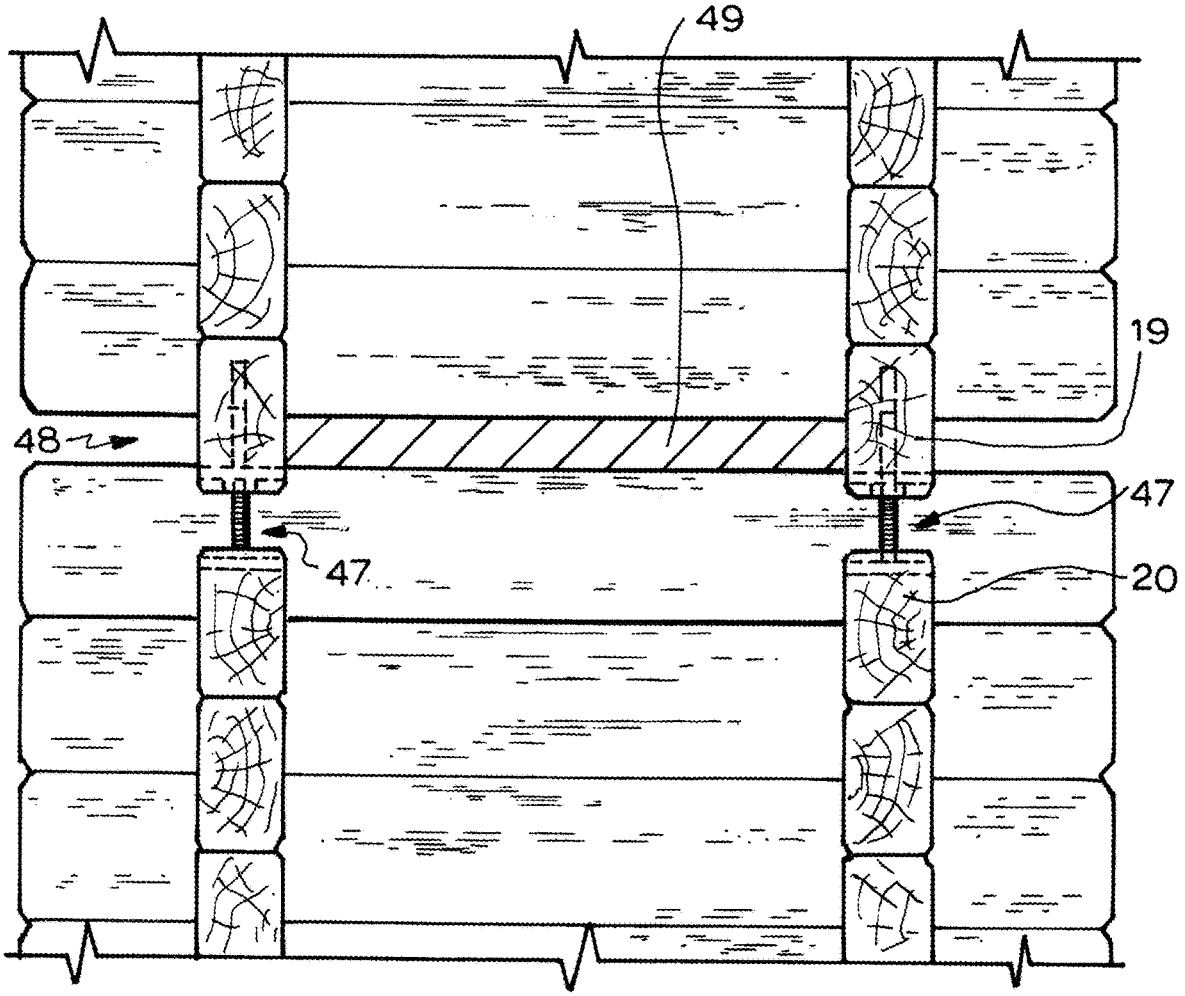
FIG. 7 is a drawing of the adjacent side of the crib showing a rigid filler between the jacked apart planks of that side.

FIGS. 6 and 7 show a gap 47, the effect of which is to create a gap on the adject sides as shown at 48 and a filler block 49 of suitable thickness is fitted into that gap so the jack slides are supported by the nuts and the adjacent sides by the filler. The crib may be easily fine tuned and may be adjusted from time to time in case of shrinkage or any other need to adjust.

Whilst the above has been given by way of illustrative example many variations and modifications will be apparent to those skilled in the art without departing from the broad ambit and scope of the invention as herein set out in the appended claims.

What is claimed is:

1. A mine crib including a preloading assembly located within the crib, the preloading assembly comprising a jack mechanism between crib members adapted to drive the said crib members apart in order to preload the crib;

wherein the crib comprises stacked crib members and the jack mechanism comprises opposed jack plates extending along the line of adjacent crib members and spaced apart screw jacks between the opposed jack plates used to jack the plates apart and thereby the said adjacent crib members, the opposed jack plates comprise upper and lower jack plates sandwiched between crib members and the screw jacks comprising spaced apart threaded rods extending through the plates and each rod having an adjustment nut located between the plates used to jack the plates apart.

2. A mine crib including a preloading assembly located within the crib, the preloading assembly comprising a jack mechanism between crib members adapted to drive the said crib members apart in order to preload the crib, the crib having opposite side walls, each said side wall having respective jack mechanisms integral with the crib and each jack mechanism being between respective members and each jack being operable within the plane of its corresponding side wall for jacking the said members in the opposite sides walls apart, the crib having adjacent walls to the said side walls which also have crib members which are adapted to separate in concert with the crib members of the said opposite side walls forming gaps in the members so separated in the adjacent walls, and there being fillers in the gaps in the adjacent walls.

3. A mine crib including a preloading assembly located within the crib, the preloading assembly comprising a jack mechanism between crib members adapted to drive the said crib members apart in order to preload the crib between a mine floor and a mine roof comprising crib members as an interlocking stack of planks, the jack mechanism being adapted to open the crib axially so that load is applied to the floor and roof, the crib having a square profile and the planks have cut outs so they are located in interlocking fashion, opposed side walls of interlocking planks comprising part way along the side wall a pair of jack planks having recesses matched to and retaining an upper jack plate and lower jack plate, the jack plates being secured in the recesses, seamlessly locate the plates and corresponding jack mechanisms in the side wall of the crib, on each of opposite sides of the crib, each has a step at each end to accommodate short plate sections of the plates, threaded rods and nut arrangement is provided and these are used to jack the plates apart thereby raising the crib.

4. A mine crib including a preloading assembly located within the crib, the preloading assembly comprising a jack mechanism between crib members adapted to drive the said crib members apart in order to preload the crib between a mine floor and a mine roof comprising crib members as an interlocking stack of planks, the jack mechanism being adapted to open the crib axially so that load is applied to the floor and roof, the crib having a square profile and the planks have cut outs so they are located in interlocking fashion, opposed side walls of interlocking planks comprising part way along the side wall a pair of jack planks comprising an upper plank and a lower plank, opposed plates between the upper and lower planks and having and threaded rods passing through holes in the plates to corresponding plank cavities in the upper plank, each rod having a nut and washer so that the nut may be used with an appropriate tool so that as the nuts are wound upward along the threaded rods then the jack planks may be jacked apart.

* * * * *